US007108554B2

(12) United States Patent
Huang

(10) Patent No.: US 7,108,554 B2
(45) Date of Patent: Sep. 19, 2006

(54) ELECTRICAL CONNECTOR WITH SHIELDING MEMBER

(75) Inventor: Chien-Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/028,128

(22) Filed: Dec. 31, 2004

(65) Prior Publication Data

US 2005/0277334 A1 Dec. 15, 2005

(30) Foreign Application Priority Data

Jun. 11, 2004 (TW) ..... 93116824 A

(51) Int. Cl.
*H01R 13/648* (2006.01)

(52) U.S. Cl. ..... 439/607; 439/378

(58) Field of Classification Search ..... 439/607, 439/609, 567, 378

See application file for complete search history.

(56) References Cited

U.S. PATENT DOCUMENTS 5,147,220 A 9/1992 Lybrand
5,356,300 A 10/1994 Costello et al.
5,919,063 A * 7/1999 Wang ..... 439/608
6,093,046 A * 7/2000 Chiou et al. ..... 439/378
6,485,328 B1 * 11/2002 Wu ..... 439/567
6,663,402 B1 * 12/2003 Yu ..... 439/108
6,672,887 B1 * 1/2004 Yu ..... 439/108
2004/0023534 A1 * 2/2004 Sasame et al. ..... 439/79
2004/0023537 A1 2/2004 Sasame et al.

* cited by examiner

*Primary Examiner*—Tulsidas C. Patel
*Assistant Examiner*—Harshad Patel
(74) *Attorney, Agent, or Firm*—Wei Te Chung

(57) ABSTRACT

An electrical connector (1) comprises an insulative housing (2) with a mating portion (23), a plurality of conductive contacts (4) located in the mating portion and a conductive shielding member (3) encircling the insulative housing. The housing includes a base portion (21) and a pair of guide posts (24) extending from the base portion along a mating direction. Each guide post extends beyond the mating portion. The shielding member includes a substantially rectangular plate (30), a frame (31) extending from the plate for completely encircling the mating portion of the housing and contacting portions (32) corresponding to the guide posts and extending beyond the mating portion for partially surrounding the guide posts. When the electrical connector is mating with a complementary connector, the contacting portion (32) electrically contacts with a conductive member arranged in the complementary connector to cause electrostatic discharge before electrical engagement of the conductive contacts. Thus, the electrostatic discharge may hardly affect the function of the conductive contacts.

3 Claims, 5 Drawing Sheets

ELECTRICAL CONNECTOR WITH SHIELDING MEMBER

BACKGROUND OF THE INVENTION

1. Field of the Invention

The present invention is generally related to the art of electrical connectors, and more particularly, to an electrical connector with a shielding member used for connecting electronic devices such as notebook computers, servers with peripheral equipments.

2. Description of Related Art

A variety of electrical connectors are widely used for transmitting power and signals between electronic devices or electronic components of the electronic devices. For meeting the requirement of integration and miniaturization of the electronic devices, printed circuit boards are design smaller than before so that the electrical connectors mounted to the printed circuit boards are spaced a narrow distance from each other. At the same time, the electrical connectors are also highly desired for high-speed transmission of electrical signals. Thus, conductive contacts located in the electrical connector are easily affected by electromagnetic interferences occurred between the electrical connectors or exterior electronic devices. For effectively reducing the electromagnetic interferences, manufactures generally provide electrical connectors each with a shielding member which is made of metal material.

U.S. Pat. No. 5,147,220 discloses an electrical connector with a shielding member. The connector includes an insulated housing, a plurality of electrical contacts arranged in the housing. The housing has a main portion and a mating portion projecting from the main portion. The electrical contacts are located in the mating portion. The shield member are mounted to the connector for encircling the housing and has a main plate covering the main portion and a frame projecting from the main plate and covering the mating portion. However, during the connector or the connector mating with a complementary connector, static electricity occurred on the connector can cause to be discharged between the conductive contacts located therein. The electrostatic discharge may adversely affect the function of signal transmission of the electrical connector.

An example of an electrical connector assembly developed to solve this problem is disclosed in U.S. Pat. No. 5,356,300. The connector assembly has a first connector provided with guide posts that protrude from a mating surface at both ends thereof. A second connector has grooves that receive the guide posts. Conductive members are provided on each of the guide posts and the grooves. The conductive members establish a grounding connection before the engagement of conductive contacts located in the mating portion to cause electrostatic discharge. However, the connector assembly doesn't have a shielding member for protecting the conductive contacts from damaging of electromagnetic interference.

U.S. Patent Application Pub. No. 2004/0023537 A1 discloses another electrical connector for solving the problems. The connector has an insulative housing with a mating portion provided with a plurality of conductive contacts therein. A shielding member is mounted to an exterior of the insulative and is connected to a circuit board. Guide posts protrude from a surface of the insulative housing for facilitating engagement of the connector with a complementary connector. The guide posts have tips positioned further from the insulative housing than the mating portion. Conductive members are arranged on the tips of the guide posts. The conductive members facilitate electrostatic discharge with the complementary connector and have retention legs connected to the printed circuit board independently from the shielding member. As the conductive members are independent from the shielding member, the complexity of the assembling the connector is increased. Hence, it is highly desired to develop a connector which can overcome the problems above mentioned.

SUMMARY OF THE INVENTION

Accordingly, an object of the present invention is to provide an electrical connector, which provides stable and reliable signal transmission.

In order to achieve the object set forth, an electrical connector is provided. The electrical connector comprises an insulative housing with a mating portion, a plurality of conductive contacts located in the mating portion and a shielding member encircling the insulative housing. The housing includes a base portion and a pair of guide posts extending from the base portion along a mating direction which the mating portion extending along. Each of the guide posts extends beyond the mating portion. The shielding member includes a substantially rectangular plate, a frame extending from the plate for encircling the mating portion of the housing and contacting portions corresponding to the guide posts and extending beyond the frame for partially surrounding the pair of guide posts. When the electrical connector is inserted into a complementary connector, the contacting portions electrically contacts with conductive members provided by the complementary connector to cause electrostatic discharge before electrical engagement of the conductive contacts.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
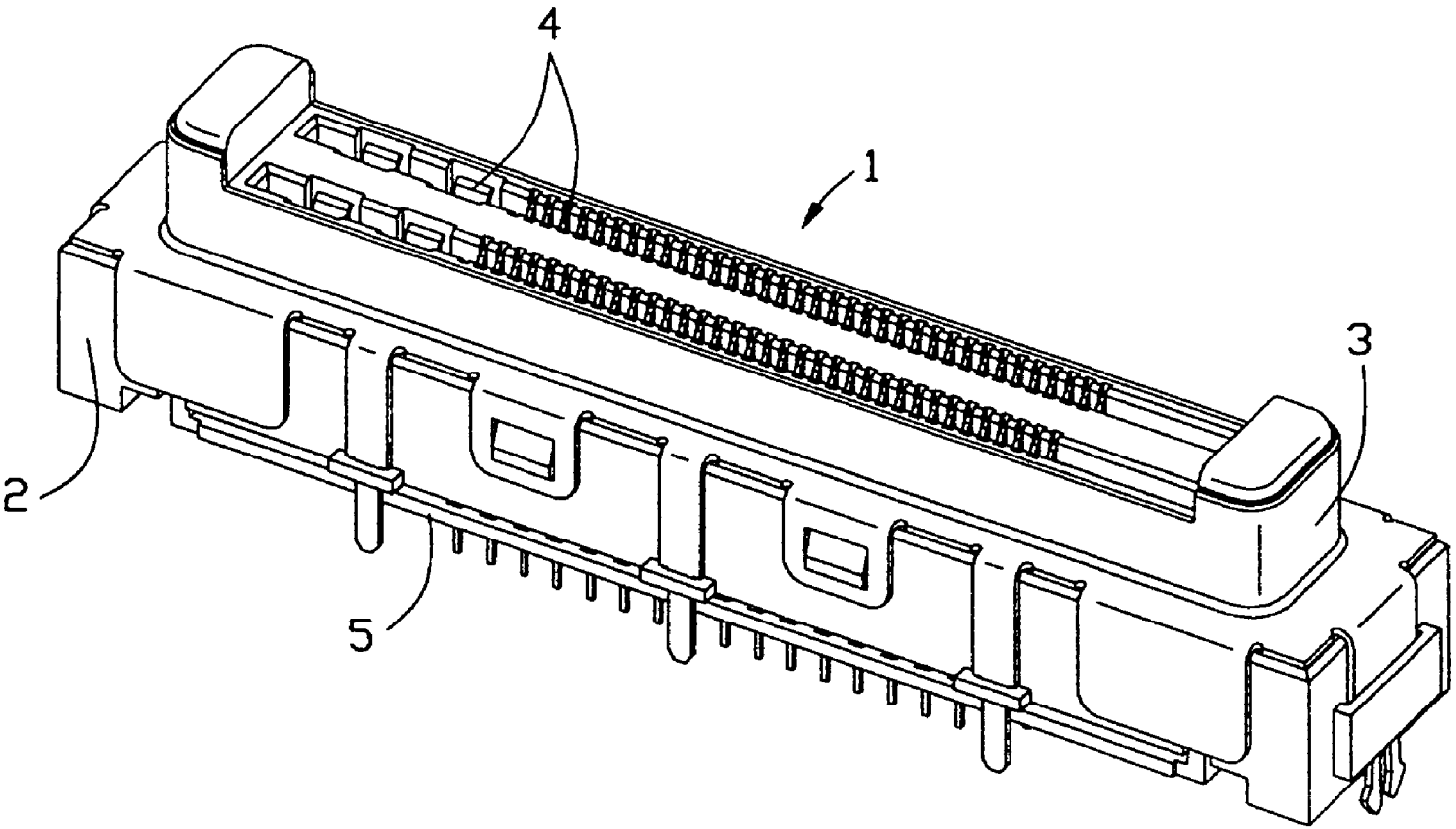
FIG. 1 is an assembled, perspective view of an electrical connector in accordance with the present invention.
Figure 2:
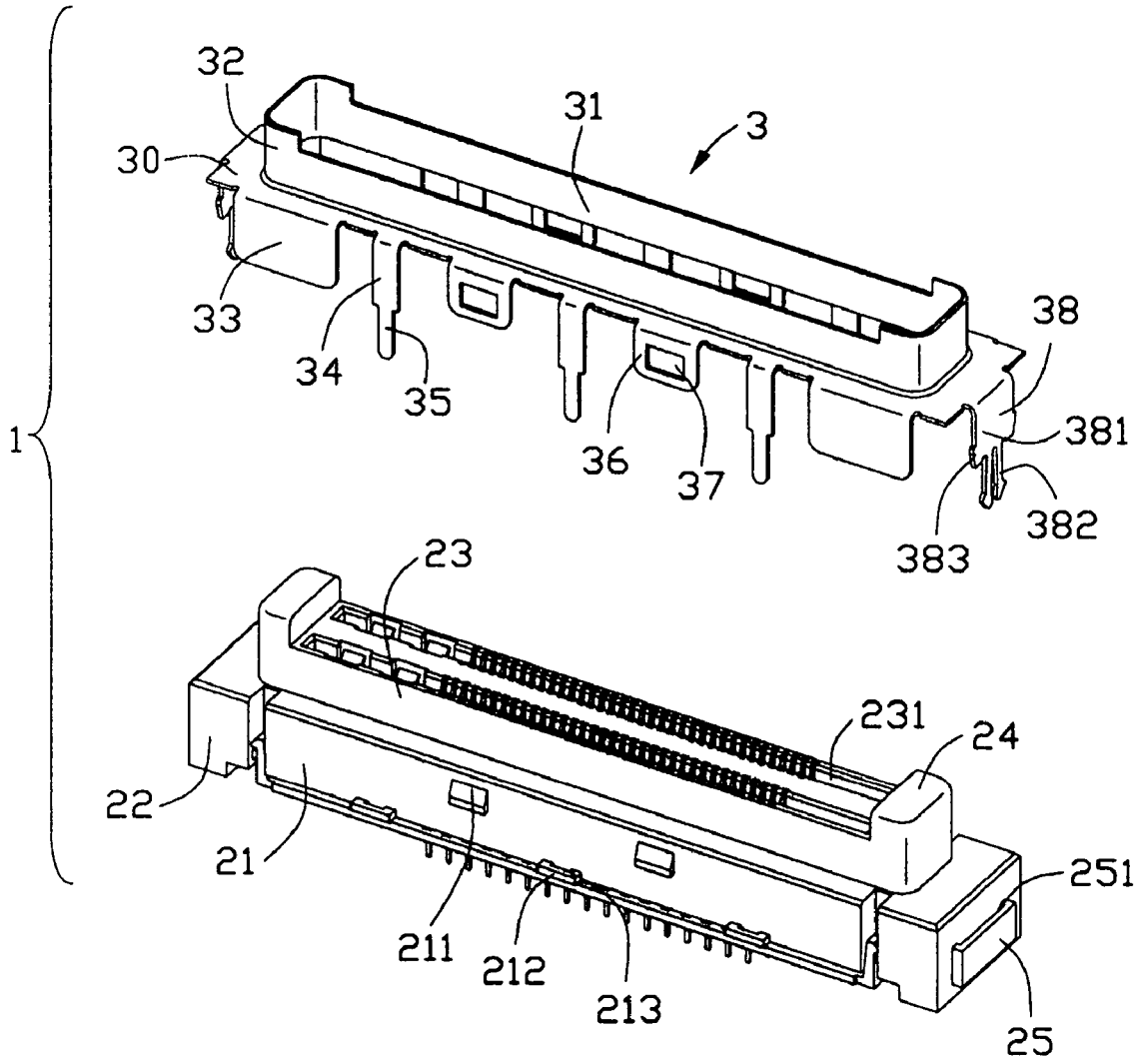
FIG. 2 is an assembled, perspective view of the electrical connector in accordance with the present invention, with the shielding member exploded.
Figure 3:
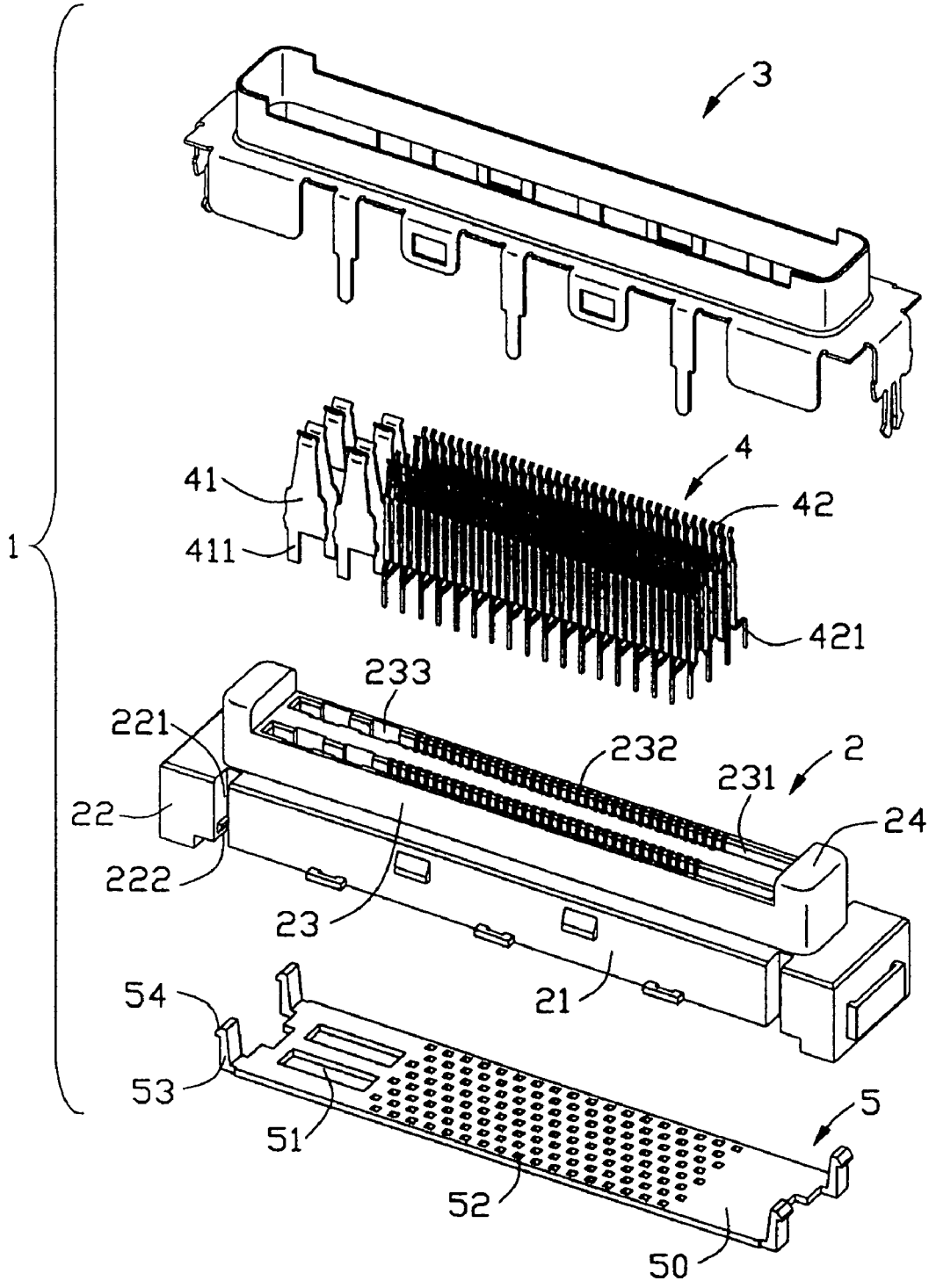
FIG. 3 is an exploded, perspective view of the electrical connector in accordance with the present invention.

Referring to FIG. 1 and FIG. 3, an electrical connector 1 comprises a substantially rectangular housing 2, a plurality of conductive contacts 4 located in the housing 2 and a shielding member 3 mounted to and encircling the housing 2.

The housing 2 has a base portion 21, a pair of mounting portions 22 extending from two opposite ends of the base portion 21, a mating portion 23 extending forwardly from the base portion 21 along a mating direction of the connector 1 and a pair of guide posts with rectangular cross section formed two opposite longitudinal ends of the mating portion 23. The mating portion 23 has a mating surface and two rectangular receiving cavities 231 defined in the mating surface. A plurality of receiving channels 232, 233 are provided on both longitudinal sides of each receiving cavity 231 and communication with the receiving cavity 231. The conductive contacts 4 comprise power contacts 41 and signal contacts 82 respectively located in corresponding receiving channels 233, 232. The base portion 21 has two wedge-shaped tubers 211 formed at upper portion thereof adjacent to the mating portion and a plurality of rectangular projections 212 formed at opposite side of the wedge-shaped tubers 211 which is adjacent to bottom surface of the base portion 21. The rectangular projections 212 are arranged in a predetermined distance and alternatively with the tubers 211. Each projection 211 has a slot 213 therein. Each mounting portion 22 has a protrusion 25 projecting from a transverse wall thereof. A fixing groove 251 is provided on the protrusion 25 and extends through the protrusion 25 along the mating direction. At the corner portions of adjacent portions between the base portion 21 and the mounting portions 22 are recessed into four passageways 221, and each passageway 221 has a locking block 222 formed therein.

The shielding member 3 is a unitary member and made of conductive material. The shielding member comprises a rectangular plate 30 covering the base portion 21 of the housing 2, a frame 31 extending forwardly from the plate 30 for encircling the mating portion 23 and a pair of contacting portions 32 corresponding to and partially surrounding the guide posts 24. The frame 31 is surrounded by two opposite longitudinal walls and two opposite transverse wall. The contacting portions 32 combine the two transverse walls to be configured in C-shaped and beyond the mating surface of the mating portion 23. The shielding member 3 further comprises a plurality of vertical sheets 33, extension bars 34 and extension pieces 36 which all extend rearwardly from both longitudinal edges of the plate 30 along the mating direction. The extension bars 34 and the extension pieces 36 are arranged alternatively between the two vertical sheets 33 and spaced each other in a predetermined internal. The extension bars 34 each has a mounting leg 35 which is located at lower portion thereof and is narrower than other parts of the extension bar 34. The extension pieces 36 each has an opening 37 therein. When the shielding member 3 is mounted to the housing 2, the mounting legs 35 extend through the slots 213 provided on the projections 212 to be mounted on a printed circuit board, and the opening 37 are cooperated with the wedged-shaped tubers 211. The shielding member further comprises locking portions 38 extending rearwardly from opposite transverse edges of the plate 30 along the mating direction. Each locking portion 38 has a main portion 381 and a pair of locking legs 382 extending rearwardly from a bottom side of the main portion 381 to be mounted to the printed circuit board (not shown). The locking portion 38 is fixing in the fixing groove 25 of the housing 2 via barbs 383 formed both sides of the main portion 381 to be interferential engagement with the fixing groove 25. When the shielding member 3 are mounted on the housing 2, the shielding member 3 entirely completely encircles the mating portion 23 and effectively protects the contacts 4 from compromising the function of power and signal transmission.

The electrical connector 1 further comprises a guide plate 5 and guiding and protecting the power contacts 41 and the signal contacts 42. The guide plate 5 is substantially rectangular in shape and comprises a plate portion 50 and a plurality of receiving grooves 51 and receiving holes 52 provided by the plate portion 50. Each power contact 41 and the signal contact 42 has a tail portion 411, 421 extending through corresponding receiving grooves 51 and receiving holes 52 for connecting with a printed circuit board. Latch arms 53 are formed at four corners of the plate portion 50 and extend forwardly from the plate portion 50 to be received in the passageways 221. The guide plate 5 is mounted to the housing 2 via a hook portion 54 provided at a free end of each latch arms 53 engaging with the locking blocks 222 of the passageways. When the connector 1 is not mounted to the printed circuit board, the guide plate 5 can effectively protect the tail portion 411, 421 from damaging.

Figure 4:
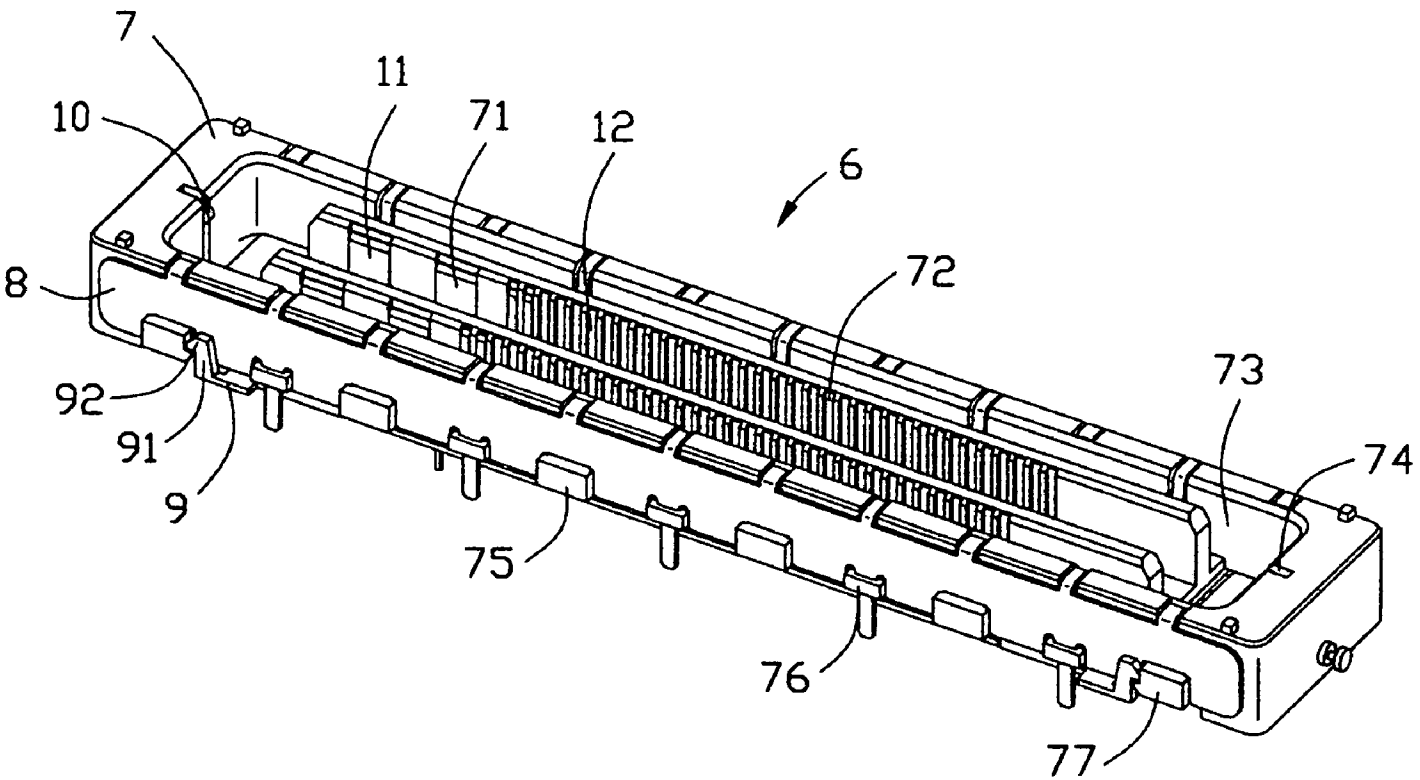
FIG. 4 is an assembled, perspective view of a complementary connector for mating with the electrical connector in accordance with the present invention.
Figure 5:
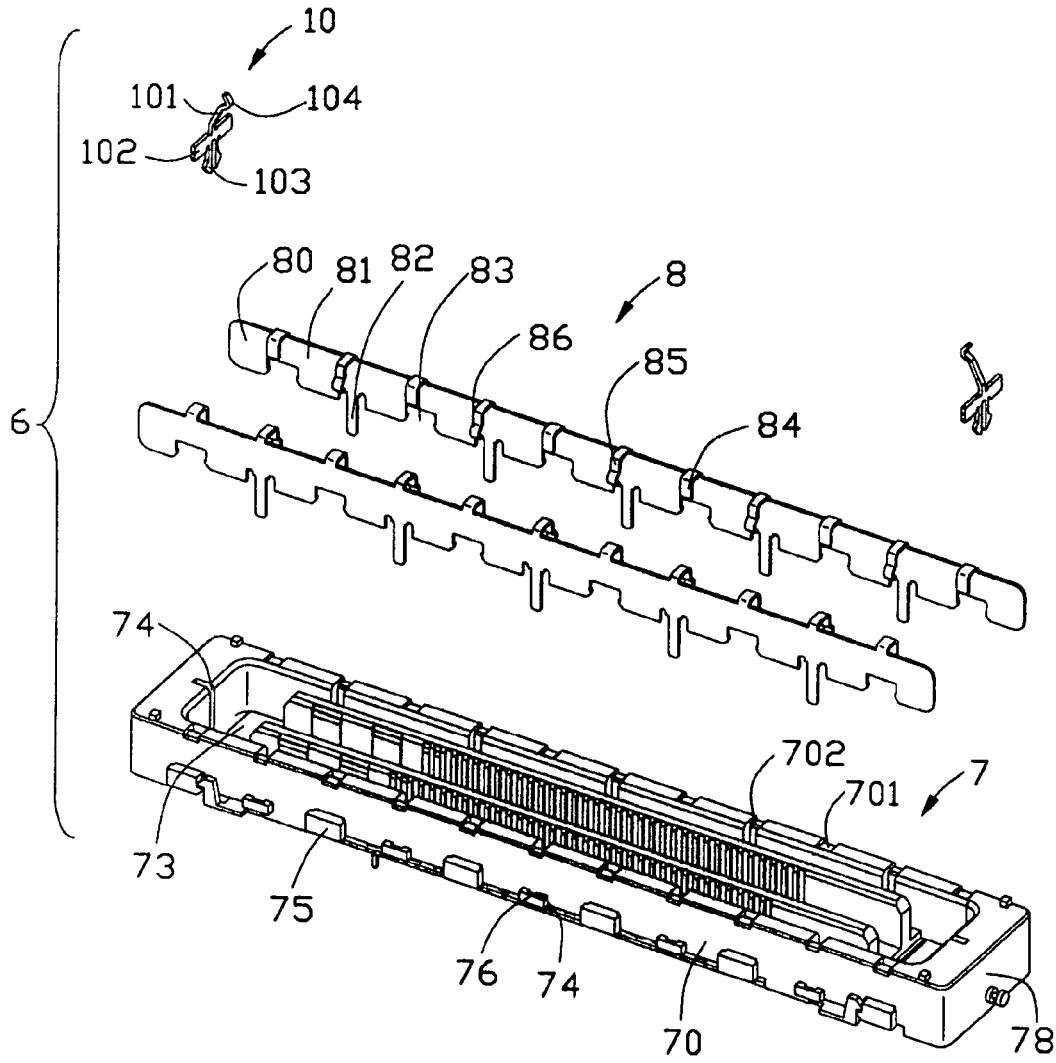
FIG. 5 is an exploded, perspective view of the complementary connector, with a pair of conductive members and a shielding member exploded.

Referring to FIG. 4 and FIG. 5, an complementary connector 6 is used to mate with the electrical connector 1. The complementary connector 6 will be described in detail so as to understand the connector 1 in accordance with the present invention. The complementary connector 6 comprises an insulative housing 7, a plurality of power and signal contacts 11, 12 located in the housing 7 and a guide plate 9 mounted to the housing 7 from a bottom wall thereof.

The housing 7 comprises a mating portion 71 surrounded by two opposite side walls 70 and two opposite transverse walls 78 adjacent to the side walls 70. The mating portion 71 has two longitudinal platforms 72 providing a plurality of receiving channels at both sides of each for retaining the plurality of power and signal contacts 11, 12 therein and two guide holes 73 located at longitudinal ends of the platforms 72 for receiving the guide posts 24 of the connector 1. Each transverse wall 78 has a notch 74 which is communication with the guide hole 73 and a front surface of the complementary connector 7. A conductive member 10 is provided to be retained in each notch 74. Each side wall 70 has a plurality of hollows 701 and recesses 702 all extending from a top surface of the side wall 70, and the hollows 701 and recesses 702 are arranged alternatively and spaced each other in a changeless interval. Each side wall 70 further comprises two locking blocks 77, a plurality of stoppers 75 and projections 76 arranged alternatively with the stoppers 75 all extending from an outside surface of the side wall 70 which is adjacent to the bottom wall of the housing 7. The two locking blocks 77 are located at two longitudinal ends of the side wall 70, and the stoppers 75 and projections 76 are located between the two locking blocks 77. Each projection 76 has a slot 74 extending through the projection 76 along the mating direction. The guide plate 9 has latch arms 91 located at each corner thereof, when the guide plate 9 is mounted on the housing 9, a hook portion 92 provided by each latch arm 91 is locked with the corresponding locking block 77 and the power and signal contacts 11, 12 each has a tail portion extending through the guide plate 9.

The complementary connector 6 further comprises a shielding member consisting of two same shaped shielding shells 80 being mounted to the side walls 70 of the housing 7. Each shielding shell 80 has a rectangular main plate 81. A plurality of mounting legs 82 extend from the a bottom edge of the main plate 81 and though the slots 74 provided by the housing 7 to be mounted to a printed circuit board (not shown). A plurality of cutouts 83 are recessed along a reverse-direction of the mounting legs 82 and arranged alternatively with the mounting legs 82. Moreover, a plurality of long fixing pieces 85 and short fixing pieces 84 extend from a top edge of the main plate 81 and are respectively retained in recesses 702 and hollows 701. The long fixing pieces 85 each has a contact portion 86 extending into the mating portion 71, when the complementary connector 6 is inserted into the connector 1, the contact portion 86 electrically contact with the frame 31 of the shielding member 3 of the connector 1.

The conductive member 10 retained in the notch 74 has a main portion 102 fixing in housing 7, a pair of locking legs 103 extending from the bottom edge of the main portion 102 to be mounted on the printed circuit board and a resilient beam 101 extending oppositely to the locking legs 103 from a top edge of the main portion 102. The resilient beam 101 has a contact portion 104 extending into and exposing at the guide hole 73.

When the complementary connector 6 mates with the connector 1, the guide posts 24 are inserted into the guide holes 73 of the complementary connector 6, and at the time the C-shaped contacting portions 32 encircling the guide posts 24 electrically contacts with the contact portions 104 of conductive members 10 exposing at the guide holes 73. When the mating process continues, the mating portions 23 of the connector 1 are inserted into the mating portion 71 of the complementary connector 6. Static electricity taken placed by operators or other objects are caused to discharged on a grounding circuit of the printed circuit board via the contacting portions 32 electrically contacting with the conductive members 10 and the locking legs 103 of the conductive members 10 electrically mounted to the grounding circuit of the printed circuit board. As the contacting portions 32 extend beyond the mating surface of the mating portion 23, electrostatic discharge takes place before the power contacts 11, 41 and signal contacts 12, 42 located in mating portions 23, 71 electrically contact with each other. Thus, the function of power and signal transmission is highly improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for engaging with a complementary connector, comprising:

an insulative housing comprising a base portion and a mating portion extending from the base portion along a mating direction, the mating portion comprising a plurality of receiving channels extending through the base portion, a guide post located beside the receiving channels and a mating surface opposing the complementary connector in the mating direction;

a plurality of conductive contacts being located in receiving channels of the mating portion;

a unitary shielding member comprising a frame completely covering the mating portion except the mating surface and a contacting portion extending from one lengthwise end of the frame and beyond the mating surface along said mating direction for essentially wrapping the guide post and electrically contacting with the complementary connector prior to the conductive contacts; and wherein the shielding member has plate covering the base portion, and the frame of the shielding member extends from the plate along the mating direction;

wherein the shielding member has a locking portion extending rearwardly from each transverse edges of she plate along the mating direction.

wherein the shielding member comprises a plurality of extension bars and extension pieces extending rearwardly from both longitudinal edges of the plate along the mating direction, and the housing comprises a plurality of slots and wedge-shaped tubers provided by the housing; and wherein the extension bars and the extension pieces are arranged alternatively and spaced a changeless interval with each other, the extension bars and the extension pieces are respectively cooperated with the slots and the wedge-shaped tubers.

2. The electrical connector as claimed in claim 1, wherein the housing has a protrusion projecting from a transverse wall thereof and a fixing groove provided on the protrusion and extending through the protrusion along the mating direction.

3. The electrical connector as claimed in claim 2, wherein the locking portion has a main portion and a pair of locking legs extending rearwardly from a bottom edge of the main portion, the locking portion is retained in the fixing groove via barbs formed both sides of the main portion.

* * * * *